US005759728A

United States Patent [19]

Hagi et al.

[11] Patent Number: 5,759,728

[45] Date of Patent: Jun. 2, 1998

[54] BLACK TONER FOR DEVELOPING ELECTROSTATIC LATENT IMAGES WITH CARBON BLACK DISPERSED IN SPECIFIC DISTRIBUTION

[75] Inventors: Masayuki Hagi, Takatsuki; Junichi Tamaoki, Sakai; Takeshi Arai, Akashi; Hiroyuki Fukuda, Kobe, all of Japan

[73] Assignee: Minolta Co. Ltd., Osaka, Japan

[21] Appl. No.: 803,162

[22] Filed: Feb. 19, 1997

[30] Foreign Application Priority Data

Feb. 20, 1996 [JP] Japan ..... 8-031963

[51] Int. Cl.[6] ..... G03G 9/09

[52] U.S. Cl. ..... 430/106; 430/111

[58] Field of Search ..... 430/106, 111

[56] References Cited

U.S. PATENT DOCUMENTS

| | | | |
|---|---|---|---|
| 4,954,411 | 9/1990 | Nishibayashi et al | 430/111 |
| 5,116,711 | 5/1992 | Kobayashi et al. | 430/106 |
| 5,126,221 | 6/1992 | Chiba et al. | 430/45 |
| 5,212,039 | 5/1993 | Demizu et al. | 430/122 |
| 5,306,589 | 4/1994 | Yamamoto et al. | 430/111 |
| 5,314,773 | 5/1994 | Kubo et al. | 430/45 |
| 5,356,747 | 10/1994 | Uno et al. | 430/109 |
| 5,620,824 | 4/1997 | Okado et al. | 430/111 |
| 5,637,427 | 6/1997 | Yamamoto et al. | 430/109 |

*Primary Examiner*—Roland Martin

[57] ABSTRACT

The present invention relates to a black toner for developing electrostatic latent images, comprising at least a binder resin and carbon black, characterized in that a mean primary particles size and particle size distribution of the carbon black dispersed in the binder resin are adjusted within a specified range.

20 Claims, No Drawings

BLACK TONER FOR DEVELOPING ELECTROSTATIC LATENT IMAGES WITH CARBON BLACK DISPERSED IN SPECIFIC DISTRIBUTION

BACKGROUND OF THE INVENTION

1. Field of the Invention

The present invention relates to a black toner for developing electrostatic latent images, especially to a black toner suitable for use in full color image-forming machine, such as a full color copying machine of electrostatic type, full color laser beam printer etc.

2. Description of the Prior Art

Image-forming systems, such as a copying machine, a printer and a facsimile, are widely utilized. In such a system, electrostatic latent images formed on electrostatic latent image-keeping member, such as a photosensitive member, are developed by toner and the developed toner is transferred onto a recording medium, such as recording paper. Recently, a full color image-forming apparatus can be available in which plural color toners are developed in layers to reproduce multicolor images.

As a coloring agent for black toner used in such a full color image-forming apparatus as above mentioned, there are known carbon black, a mixture of cyan pigment, magenta pigment and yellow pigment etc. When carbon black is used as a coloring agent, it is required that an addition amount of carbon black is smaller than that of conventional black toner for forming black and white images. In the full color image-forming apparatus, black toner and color toners are electrically charged almost equally, but when carbon black is added a lot, it becomes difficult to charge equally each of color toners and black toner because of difference of chargeability between color toners, such as cyan toner, and black toner, caused by electrical conductivity of carbon black. In the case where a full color image-forming apparatus reproduces area gradation, the area gradation can not be reproduced satisfactorily in high density area of images when an addition amount of carbon black is large, because optical density of toner images is saturated not to vary in spite of increase of toner adherence. In the case of full color apparatus in which gradation is made by means of laser beam, there arises such a serious problem that reproducibility of linear gradation in the area ranging from low density to high density is deteriorated when carbon black is added a lot.

However, although an addition amount is made low from the viewpoint above mentioned, black images become reddish so that satisfactory black color can not be reproduced, because carbon black itself is reddish to influence much on its color. In order to solve this problem, it may be thought that blue-type of coloring agent is added. This idea is not preferable because there arises such a problem as adjustment of chargeability of each toners and cost-increase etc.

SUMMARY OF THE INVENTION

The object of the present invention is to provide a black toner for full color image-forming apparatus which can reproduce excellent black images, showing no problem as above mentioned.

The present invention relates to a black toner containing binder resin and carbon black, characterized in that:

the carbon black is contained at an amount of 2–20 parts by weight on the basis of 100 parts by weight of the binder resin, a mean primary particle size of the carbon black dispersed in the binder resin is within the range between 15 and 35 nm, a number ratio of the carbon black having a primary particle size within the range of the mean primary particle size ±5 nm is between 15 and 40 number percent, a number ratio of the carbon black having a primary particle size within the range of the mean primary particle size ±15 nm is between 45 and 75 number percent, and a number ratio of the carbon black having a primary particle size between the range of the mean primary particle size ±15 nm and the mean primary particle size ±45 nm is between 15 and 35 number percent.

DETAILED DESCRIPTION OF THE INVENTION

The present invention relates to a black toner containing binder resin and carbon black, characterized in that:

the carbon black is contained at an amount of 2–20 parts by weight on the basis of 100 parts by weight of the binder resin, a mean primary particle size of the carbon black dispersed in the binder resin is within the range between 15 and 35 nm, a number ratio of the carbon black having a primary particle size within the range of the mean primary particle size ±5 nm is between 15 and 40 number percent, a number ratio of the carbon black having a primary particle size within the range of the mean primary particle size ±15 nm is between 45 and 75 number percent, a number ratio of the carbon black having a primary particle size between the range of the mean primary particle size ±15 nm and the mean primary particle size ±45 nm is between 15 and 35 number percent.

The present invention also relates to a black toner for full color image-forming machine reproducing multicolor image by using magenta toner, cyan toner, yellow toner and black toner, comprising carbon black and binder resin, characterized in that:

the carbon black is contained at an amount of 2–7 parts by weight on the basis of 100 parts by weight of the binder resin, a mean primary particle size of the carbon black dispersed in the binder resin is within the range between 15 and 35 nm, a number ratio of the carbon black having a primary particle size within the range of the mean primary particle size ±5 nm is between 15 and 40 number percent, a number ratio of the carbon black having a primary particle size within the range of the mean primary particle size ±15 nm is between 45 and 75 number percent, and a number ratio of the carbon black having a primary particle size between the range of the mean primary particle size ±15 nm and the mean primary particle size ±45 nm is between 15 and 35 number percent.

The toner of the present invention has a specified distribution of particle size of carbon black. When generally explained, an average primary particle size of carbon black dispersed in toner is small and a distribution of particle size is broad. Thereby, the black toner of the present invention is excellent in reproducibility of black color.

The black toner of the present invention has such a distribution of carbon black as:

- a mean primary particle size of the carbon black dispersed in the binder resin is within the range between 15 and 35 nm, preferably 20 and 30 nm,
- a number ratio of the carbon black having a primary particle size within the range of the mean primary particle size ±5 nm is between 15 and 40 number percent, preferably 20 and 35 number percent,
- a number ratio of the carbon black having a primary particle size within the range of the mean primary particle size ±15 nm is between 45 and 75 number percent, preferably 50 and 70 number percent,
- a number ratio of the carbon black having a primary particle size between the range of the mean primary particle size ±15 nm and the mean primary particle size ±45 nm is between 15 and 35 number percent, preferably 15 and 35 number percent. More preferably, a number ratio of the carbon black having a primary particle size between the range of the mean primary particle size ±25 nm and the mean primary particle size ±55 nm is between 5 and 30 number percent, preferably 10 and 25 number percent in the distribution of particle size of carbon black. Such a distribution of particle size of carbon black can solve the problem of black images wearing reddish color in spite of small average mean particle size of carbon black.

The average primary particle size of carbon black dispersed in a binder resin and distribution thereof is measured in the present invention by observing a cross section of toner cut by use of microtome by means of transmission type electron microscope (TEM).

In order to adjust the distribution of particle size of carbon dispersed in toner to such a range as above mentioned in the present invention, it is preferable to use carbon black having distribution of particle size as above mentioned. For example, #260 carbon black (made by Mitsubishi Kagaku K.K.) can be available in the market. Plural kinds of carbon black having different average primary particle size may be mixed to adjust the distribution.

It may be more preferable in the present invention to use carbon black for the black toner having an average primary particle size within the range between 15 and 35 nm, preferably 20 and 30 nm, a BET specific surface area between 50 and 90 $m^2/g$, preferably 50 and 85 $m^2$, and DBP (dibutyl phthalate) absorption is between 50 and 90 ml/100 g, preferably 60 and 80 ml/100 g.

In the present invention, small particle size carbon black having an average primary particle size between 15 and 35 nm is adopted from the viewpoint of safety. If the size is larger than 35 nm, it is effective to improve redness of black image. But, there is a high possibility that harmful PHA (polycyclic aromatic hydrocarbons) are liable to be incorporated as by-product. Coloring power is lowered, so that image density tends to be lowered. When the size is less than 15 nm, dispersibility in binder resin is deteriorated, chargeability of toner is influenced adversely and black images become reddish. When carbon black has average primary particle size, specific surface area and oil absorption specified as above mentioned, wettability to binder resin is improved to effect dispersibility. In addition, carbon black having pH between 7.0 and 9.0 is preferably used.

When the black toner of the present invention for developing electrostatic latent images is applied to an apparatus for forming black and white copy images, the carbon black is contained at an amount of 2–20 parts by weight, preferably 3–15 parts by weight on the basis of 100 parts by weight of binder resin. If the content is less than 2 parts by weight, sufficient black-color reproducibility and hiding power may not be achieved. If the content is more than 20 parts by weight, dispersibility in the binder resin becomes poor, so that ununiformity of chargeability occurs, and charging amount decays, so that fogs are apt to be formed.

When the black toner of the present invention is applied to an apparatus for forming full color images, the carbon black is contained at an amount of 2–7 parts by weight, preferably 3–5 parts by weight on the basis of 100 parts by weight of binder resin. If the content is less than 2 parts by weight, sufficient black-color reproducibility and hiding power may not be achieved. If the content is more than 20 parts by weight, the above mentioned problems may arise.

The binder resin contained in the black toner of the present invention is exemplified by styrenic resins, acrylic resins, such as methyl acrylate, butyl acrylate, methyl methacrylate and butyl methacrylate, styrene-acrylic copolymer, polyester resins, epoxy resins, silicone resins, olefin resins, amide resins and other known resins. These resin may be used singly or in combination. Because the binder resin for color toner is preferably polyester resins, epoxy resins or styrene-acrylic copolymer, the same resin for color toner is preferably used when black toner is used for full color.

It is preferable that a binder resin contained in color toner is the one having a number average molecular weight of 3,000 to 6,000, preferably 3,500 to 5,500, a ratio of weight average molecular weight to number average molecular weight of 1 to 8, preferably 2 to 6, a glass transition point of 50° to 75° C., preferably 90° to 110° C., and a softening point of 90° to 115° C., from the viewpoint of fixability, keeping stability and light-transparency etc. As a color toner, a magenta toner containing at least a binder resin and a magenta coloring agent, such as magenta pigment and magenta dye, a cyan toner containing at least a binder resin and a cyan coloring agent, such as cyan pigment and cyan dye, and a yellow toner containing at least a binder resin and a yellow coloring agent, such as a yellow pigment and yellow dye.

If desired, additives, such as charge controlling agent, magnetic particles and wax may be added to the toner of the present invention in addition to the binder resin and carbon black.

For the charge controlling agent, any known charge controlling agents may be used, for example, metal complex salicylates, such as zinc complex etc., calix arene compounds, boron organic compounds, fluorine-containing quaternary ammonium salt compounds and other known charge controlling agent. The metal complex salicylates which may be used in the present invention are disclosed in, for example, Japanese patent laid-open Nos. Sho 53-127,726 and 62-145,255. The calix arene compounds which may be used in the present invention are disclosed in, for example, Japanese patent laid-open No. Hei2-201,378. The boron organic compound which may be used in the present invention are disclosed in, for example, Japanese Patent laid-open No. Hei 2-221,967. The fluorine-containing quaternary ammonium salt compounds which may be used in the present invention are disclosed in, for example, Japanese Patent laid-open No. Hei 3-1,162. The charge controlling agent may be contained in the toner or adhered to the toner surface. When the charge controlling agent is added, an amount thereof is 0.1–10 parts by weight, preferably 0.5–5.0 parts by weight on the basis of 100 parts by weight of binder resin.

The wax which may be used in the present invention is exemplified by synthetic waxes, such as polyethylene and polypropylene, and natural waxes, such as carnauba wax and sazol wax. The addition of these waxes effects to improve off-set resistance and transportability. When the wax is added, an amount thereof is 0.5–10 parts by weight, preferably 1–6 parts by weight.

It is preferable for the toner of the present invention to be added and mixed with a post-treating agent from the viewpoint of improvement of toner flowability.

Such a post-treating agent is exemplified by silica, alumina, titania, tin oxide and zirconium oxide. They can be used singly and in combination.

The post-treating agent is preferably made hydrophobic from the viewpoint of environmental stability. The hydrophobic agents are exemplified by coupling agents, such as silanes, titanates, aluminates and zirconium aluminates and silicone oil.

The post treating agent is preferably used in combination with hydrophobic silica and hydrophobic titania, or hydrophobic silica and hydrophobic alumina from the viewpoint of fluidity and environmental stability of chargeability. The post treating agent is added at a preferable amount of 0.2–3.0 parts by weight relative to toner.

The toner is prepared such that volume average particle size is adjusted to 5–10 μm, preferably 6–9 μm from the viewpoint of reproducibility of very fine images.

The black toner of the present invention may be used as one component of a two-component developer containing a carrier, or a one-component developing toner without a carrier.

When the carrier is used in combination with the toner of the present invention, any carrier which is conventionally known as the one for two-component developer may be used. For example, a carrier constituted of magnetic particles, such as iron and ferrite, a resin-coated carrier constituted of resin-coated magnetic particles, or a binder-type carrier with magnetic particles dispersed in binder resin may be used. Among these carriers, the resin-coated carrier in which silicone resin, copolymer resin (graft polymer resin) of organopolysiloxane monomer and vinyl monomer, or polyester resin is used, and the binder-type carrier in which polyester resin is used as a binder resin, are preferably used from the viewpoint of toner-spent resistance. In particular, the preferable carrier is the one coated with a resin which is prepared by reacting copolymer of organopolysiloxane and vinyl monomer with isocyanate from the viewpoint of durability, environmental stability and spent-resistance. It is preferable that the carrier having a mean volume particle size of 20–60 μm from the viewpoint of high quality image and prevention of carrier fogging.

The black toner of the present invention may be preferable applied to a full color image-forming apparatus in which electrostatic latent images are formed dot by dot on a photosensitive member charged electrically and uniformly by digital writing system, such as laser-beam optical system and light-shutter optical system and the electrostatic latent images are developed by magenta toner, cyan toner, yellow toner and black toner. In more detail about an image-forming method, the following methods are given:

electrostatic latent images corresponding to specific color are formed on a photosensitive member, the electrostatic latent images are developed by a specific toner corresponding to the color, the toner is transferred to an intermediate transferring member, and then each process is repeated with respect to each color to form toner images laminated on the intermediate transferring member and the toner images are transferred to and fixed on a recording medium;

electrostatic latent images corresponding to specific color are formed on a photosensitive member, the electrostatic latent images are developed by a specific toner corresponding to the color, the toner is transferred to a recording medium hold on an intermediate transferring member, and then each process is repeated with respect to each color to form toner images laminated on the recording member and the toner images are fixed;

and electrostatic latent images corresponding to specific color are formed on a photosensitive member, the electrostatic latent images are developed by a specific toner corresponding to the color, and then each process is repeated with respect to each color to form toner images laminated on the photosensitive member and the toner images are transferred to and fixed on a recording medium.

Hereinafter, specific examples are shown below, but these are shown with no significance in restricting the embodiments of the present invention.

(Preparation of Polyester Resin A)

A 2-liter 4-necked flask, fitted with a reflux condenser, a water separator, a nitrogen gas inlet, a thermometer, and an agitator, was installed in a mantle heater. Into this flask were charged polyoxypropylene (2,2)-2,2-bis (4-hydroxyphenyl) propane (PO), polyoxyethylene (2,0)-2,2-bis (4-hydroxyphenyl) propane (EO), fumaric acid (FA) and terephthalic acid (TPA) to a molar ratio of 5:5:5:4, which were heated and agitated for reaction while nitrogen was being introduced into the flask. The progress of reaction was tracked while an acid value was measured, and reaction was terminated when a predetermined acid value was reached. Thus, polyester resin A (number average molecular weight:4800, ratio of weight average molecular weight Mw to number average molecular weight Mn (Mw/Mn):4.0, glass transition point:58° C., softening point:100° C. was obtained.

For measurement of Mw and Mn, gel permeation chromatography (807-IT type; made by Nihon Bunko Kogyo K.K.) was employed. With the column kept at 40° C., tetrahydrofuran was allowed to flow at 1 kg/cm$^2$ as a carrier solvent and 0.5 ml of a solution prepared by dissolving 30 mg of sample in 20 ml of tetrahydrofuran was introduced together with the carrier solvent into the column. Molecular weight was determined as converted to a polystyrene basis.

For measurement of glass transition point, a differential scanning calorimeter (DSC-200; made by Seiko Denshi K.K.) was employed. Sample of 10 mg was used. Alumina was used as reference. Temperature was raised at a heating rate of 10° C./min. In this heating process, a shoulder value of main endothermic peaks was taken as glass transition point Tg.

Softening point was measured by a flow tester (CFT-500; made by Simazu Seisakusyo K.K.) under the following conditions; sample:1.0 g, die:1.0 mm×1.0 mm, heating rate:3.0° C./min., preheating time:180 sec, loading:30 Kg, measuring temperature range:60°–140° C. The point when half of the sample flowed out is regarded as Tm.

Preparation of Polyester Resin B

A 2-liter 4-necked flask, fitted with a reflux condenser, a water separator, a nitrogen gas inlet, a thermometer, and an agitator, was installed in a mantle heater. Into this flask were charged 735 g of polyoxypropylene (2,2)-2,2-bis (4-hydroxyphenyl) propane, 292.5 g of polyoxyethylene (2,0)-2,2-bis (4-hydroxyphenyl) propane, 448.2 g of terephthalic acid and 22 g of trimellitic acid, which were agitated for reaction at 220° C. while nitrogen was being introduced into the flask. The progress of reaction was tracked while an acid value was measured, and reaction was terminated when a predetermined acid value was reached. Thus, polyester resin B1 having a softening point of 108.3° C. was obtained.

Polyester resin B2 having a softening point of 152.5° C. was obtained in the same way as in the preparation of polyester resin B1, except that 735 g of polyoxypropylene (2.2)-2,2-bis (4-hydroxyphenyl) propane, 292.5 g of polyoxyethylene (2.0)-2,2-bis (4-hydroxyphenyl) propane, 249 g of terephthalic acid, and 177 g of succinic acid and 22 g of trimellitic acid (TMA) were used.

Polyester resin B was obtained by mixing 65 parts by weight of polyester resin B1 with 35 parts by weight of polyester resin B2

EXAMPLE 1

Polyester resin A (100 parts by weight), 3 parts by weight of carbon black (#260, made by Mitsubishi Kagaku K.K.; mean primary particle size:24 nm, BET specific surface area:70 $m^2/g$, oil absorption:73 ml/100 g, pH:8) and 2 parts by weight of a charge controlling agent (E-84, made by Orient Kagaku Kogyo K.K.; zinc salicylate complex) were mixed in 9-liter Henschel mixer at 300 rpm for 4 minutes. The mixture was kneaded in a two-axial extruder while rotating screw at 150 rpm at a barrel temperature of 120° C. The kneaded material was cooled, pulverized roughly by a feather mill, pulverized finely by I-DS-2 jet mill and then classified by DS-2 air flow classifier to give toner particles having volume mean particle size of 8.0 μm.

A cross section of toner particles cut by use of microtome was observed by means of transmission type electron microscope (TEM). Carbon black dispersed in the toner particles have a mean particle size of 25 nm and such a distribution as 24.8 number percent of the primary particles was within the range of the mean primary particle size ±5 nm, 61.1 number percent of the primary particles was within the range of the mean primary particle size ±15 nm, 20.2 number percent of the primary particles was between the range of the mean primary particle size ±15 nm and the mean primary particle size ±45 nm, 14.4 number percent of the primary particles was between the range of the mean primary particle size ±25 nm and the mean primary particle size ±55 nm.

The resultant toner was added externally with 0.4 percent by weight of hydrophobic silica (H2,000, made by Aerosil K.K.), 0.6 percent by weight of hydrophobic titania fine particles (STT30A, made by Titan Kogyo K.K.) in Henschel mixer to give toner 1.

EXAMPLE 2

Toner particles were prepared in a manner similar to Example 1, except that 5 parts by weight of carbon black were added. Mean primary particle size and distribution of the primary particles of carbon black dispersed in the toner were approximately as same as those of Example 1.

The toner particles were post-treated in a manner similar to Example 1 to give toner 2.

Comparative Example 1

Toner particles were prepared in a manner similar to Example 1, except that carbon black (Mogul L, made by Cabot K.K.; mean primary particle size:24 nm, BET specific surface area:138 $m^2/g$, oil absorption:60 ml/100 g, pH:2.5) was used. Carbon black dispersed in the toner particles have a mean particle size of 25 nm and such a distribution that 48.1 number percent of the primary particles was within the range of the mean primary particle size ±5 nm, 89.8 number percent of the primary particles was within the range of the mean primary particle size ±15 nm, 10.3 number percent of the primary particles was between the range of the mean primary particle size ±15 nm and the mean primary particle size ±45 nm, 1.0 number percent of the primary particles was between the range of the mean primary particle size ±25 nm and the mean primary particle size ±55 nm.

The toner particles were post-treated in a manner similar to Example 1 to give toner 3.

Comparative Example 2

Toner particles were prepared in a manner similar to Example 1, except that carbon black (#25, made by Mitsubishi Kagagu K.K.; mean primary particle size:40 nm, BET specific surface area:55 $m^2/g$, oil absorption:70 ml/100 g, pH:8) was used. Carbon black dispersed in the toner particles have a mean particle size of 41 nm and such a distribution that 33.0 number percent of the primary particles was within the range of the mean primary particle size ±5 nm, 76.3 number percent of the primary particles was within the range of the mean primary particle size ±15 nm, 13.3 number percent of the primary particles was between the range of the mean primary particle size ±15 nm and the mean primary particle size ±45 nm, 7.2 number percent of the primary particles was between the range of the mean primary particle size ±25 nm and the mean primary particle size ±55 nm.

The toner particles were post-treated in a manner similar to Example 1 to give toner 4.

Comparative Example 3

Toner particles were prepared in a manner similar to Example 1, except that 1 part by weight of carbon black was added. Mean primary particle size and distribution of the primary particles of carbon black dispersed in the toner were approximately as same as those of Example 1.

The toner particles were post-treated in a manner similar to Example 1 to give toner 5.

Comparative Example 4

Toner particles were prepared in a manner similar to Example 1, except that 8 parts by weight of carbon black were added. Mean primary particle size and distribution of the primary particles of carbon black dispersed in the toner were approximately as same as those of Example 1.

The toner particles were post-treated in a manner similar to Example 1 to give toner 6.

EXAMPLE 3

Polyester resin B (100 parts by weight), 3 parts by weight of oxidized polypropylene (Biscol TS-200, made by Sanyo Kasei Kogyo K.K.), 5 parts by weight of negative charge controlling agent (Bontron S-34, made by Orient Kagaku Kogyo K.K.) and 10 parts by weight of carbon black (#260, made by Mitsubishi Kagaku K.K.) were mixed in Henschel mixer. The mixture was melt and kneaded in a two-axial extruder. The kneaded material was cooled, pulverized roughly by a hammer mill, pulverized finely by a jet mill and then classified finely by a rotor classifier (100/4ATP, made by Hosokawamicron K.K.) to give a toner (toner 6) that contains toner particles having a volume mean particle size of 8.6 μm. Mean primary particle size and distribution of the primary particles of carbon black dispersed in the toner were approximately as same as those of Example 1.

The resultant toner (tone 6) was added with 0.4 percent by weight of hydrophobic silica (H2,000, made by Aerosil K.K.), 0.2 percent by weight of electrically conductive titanium (EC300, made by Titan Kogyo K.K.) to give toner 7.

Production Example of Carrier 1

Methyl ethyl ketone (100 parts by weight) was charged into a 500 ml flask, fitted with an agitator, a condenser, a thermometer, a nitrogen gas inlet, and a dropping funnel. Separately, 36.7 parts by weight of methyl methacrylate, 5.1 parts by weight of 2-hydroxyethyl methacrylate, 58.2 parts by weight of 3-methacryloxypropyl tris(trimethylsiloxy) silane and 1 part by weight of 1,1'-azobis(cyclohexane-1-carbonitrile) were dissolved in 100 parts by weight of methyl ethyl ketone at 80° C. under nitrogen atmosphere. The resultant solution was added into the flask drop by drop for 2 hours. The solution in the flask was aged for 5 hours.

, Isophorone diisocyanate/trimethylolpropane adduct (IPDI/TMP:NCO%=6.1%) was added as a crosslinking agent, so that the OH/NCO molar ratio could be 1/1. The resultant solution was diluted with methyl ethyl ketone to give a coating resin-solution having solids concentration of 3% by weight.

Sintered ferrite particles (F-300, made by Powdertech K.K.; mean particle size:50 μm) were used as a core material. The coating resin-solution was applied to the ferrite particles by SPIRA COTA (made by Okada Seiko K.K.), so that a resin coating amount could be 1.5% by weight relative to core material after drying. The resultant carrier was sintered at 160° C. for 1 hour in an oven with internal air circulation. After cooling, the obtained ferrite bulk was pulverized by a sifting and shaking apparatus equipped with screen mesh having openings of 106 μm and 75 μm. Thus, resin-coated carrier 1 was prepared.

Production Example of Carrier 2

Polyester resin (100 parts by weight) having number average molecular weight of 5,000, weight average molecular weight of 115,000, glass transition point of 67° C. and softening point of 123° C., 500 parts by weight of ferrite fine particles (MFP-2, made by TDK K.K.) and 3 parts by weight of silica (Aerosil #200, made by Nippon Aerosil K.K.) were mixed sufficiently in Henschel mixer. The mixture was melt and kneaded in a two-axial extruder. The kneaded material was cooled and pulverized roughly. The roughly pulverized particles were pulverized finely by a jet mill and then classified by an air classifier to give carrier 2 having mean particle size of 60 μm.

Image density

Each of toners 1–6 was mixed with the carrier 1 at 7 wt % of toner to give a developer. A modified digital full color copying machine in which image toner is reproduced depending on laser strength (CF80, made by Minolta K.K.) was used to copy toner patterns with the obtained developer. Toner adhering-amount was adjusted to be 0.1–0.7 mg/cm$^2$ when copied on genuine paper for CF80. The image density of copy images having maximum-adhering amount of 0.7 mg/cm$^2$ was measured by Macbeth reflective densitometer RD-900. It is regarded as an optimum value when the image density at the portion having maximum adhering-amount of 0.7 mg/cm$^2$ was 1.2. The evaluation was made as follows. When the image density was 1.4 or more, the evaluation was ranked as "x" because the image density could not be controlled by toner-adhering amount. The image density between 1.3 or more and less than 1.4 was ranked as "Δ". The image density between 1.2 or more and less than 1.3 was ranked as "o". The image density between 1.1 or more and less than 1.2 was ranked as "Δ". When the image density was less than 1.1, the evaluation was ranked as "x" because the image density was low. The results were shown in Table 1.

Maximum chroma of black images

Copy images were formed in the same way as in the evaluation of image density. The chroma of copy images with different toner and different adhering-amount was measured as L*a*b coordinate space by means of spectrophotometry $$\text{Chroma}=((a^*)^2+(b^*))^{1/2}$$

Largest chroma among chromas of each tone pattern was regarded as maximum chroma. The maximum chroma of less than 2.0 was ranked as "◎". The maximum chroma between 2.0 or more and less than 3.0 was ranked as "o". The maximum chroma between 3.0 or more and less than 4.0 was ranked as "Δ". The maximum chroma of 4.0 or more ranked as "x". The copy images having the rank of "Δ" or better can be put into practical use. But, as those copy images were a little reddish, copy images having the rank of "o" or more are preferable. The results are shown in Table 1.

Fogging

Copy images were formed in the same way as in the evaluation of image density. Images formed were visually evaluated. Where almost no fog occurred around the copy images, the toner was ranked as "o"; where fog slightly occurred but considered practically no problem, the toner was ranked as "Δ"; where many fogs occurred, which was considered to be a problem from practical point of view, the toner was ranked "x". The results were shown in Table 1.

TABLE 1

| | Toner | Carrier | Image Denstiy | | Maximum Chroma | | Fogging |
|---|---|---|---|---|---|---|---|
| Example 1 | 1 | 1 | 1.22 | ○ | 2.4 | ○ | ○ |
| Example 2 | 2 | 1 | 1.31 | Δ | 1.8 | ◎ | ○ |
| Comparative Example 1 | 3 | 1 | 1.26 | ○ | 5.0 | x | ○ |
| Comparative Example 2 | 4 | 1 | 1.07 | x | 2.3 | ○ | ○ |
| Comparative Example 3 | 5 | 1 | 0.86 | x | 2.8 | ○ | ○ |
| Comparative Example 4 | 6 | 1 | 1.45 | x | 1.5 | ◎ | x |

Separately, the toner 7 was mixed with the carrier 2 at 5% by weight of toner to give a developer. This developer was applied to monocolor digital copying machine (Di-30, made by Minolta K.K.) to evaluate copy images. The formed copy images had no fogs and were excellent in degree of black color, having image density of 1.4.

According to the present invention, excellent black copy image can be formed. Especially, the black toner of the present invention can be applied to a full-color image-forming apparatus to form black copy images excellent in image-quality, such as image-tone reproducibility.

What is claimed is:

1. A black toner, comprising:

binder resin; and carbon black at an amount of 2–20 parts by weight on a basis of 100 parts by weight of the binder resin, a mean primary particle size of the carbon black dispersed in the binder resin is within a range between 15 and 35 nm, a number ratio of the carbon black having a primary particle size within a range of the mean primary particle size±5 nm is between 15 and 40 number percent, a number ratio of the carbon black having a primary particle size within a range of the mean primary particle size±15 nm is between 45 and 75 number percent, and a number ratio of the carbon black having a primary particle size between a range of the mean primary particle size+15 nm and the mean primary particle size+45 nm is between 15 and 35 number percent.

2. The black toner of claim 1, in which a number ratio of the carbon black having a primary particle size between a range of the mean primary particle size+25 nm and the mean primary particle size+55 nm is between 5 and 30 number percent.

3. The black toner of claim 1, in which:

a number ratio of the carbon black having a primary particle size within a range of the mean primary particle size±5 nm is between 20 and 35 number percent, a number ratio of the carbon black having a primary particle size within a range of the mean primary particle size±15 nm is between 50 and 70 number percent, a number ratio of the carbon black having a primary particle size between a range of the mean primary particle size+15 nm and the mean primary particle size+45 nm is between 15 and 30 number percent.

4. The black toner of claim 3, in which a mean primary particle size of the carbon black is within a range between 20 and 30 nm.

5. The black toner of claim 3, in which a number ratio of the carbon black having a primary particle size between a range of the mean primary particle size+25 nm and the mean primary particle size+55 nm is between 10 and 25 number percent.

6. The black toner of claim 1, in which the carbon black has a pH of 7–9.

7. The black toner of claim 1, further comprising a wax at an amount of 0.5–10 parts by weight on a basis of 100 parts by weight of the binder resin.

8. A black toner for a full color image-forming machine that reproduces multicolor images by using magenta toner, cyan toner, yellow toner and black toner, wherein the black toner comprises carbon black and binder resin, and wherein:

the carbon black is contained at an amount of 2–7 parts by weight on a basis of 100 parts by weight of the binder resin, a mean primary particle size of the carbon black dispersed in the binder resin is within a range between 15 and 35 nm, a number ratio of the carbon black having a primary particle size within a range of the mean primary particle size±5 nm is between 15 and 40 number percent, a number ratio of the carbon black having a primary particle size within a range of the mean primary particle size±15 nm is between 45 and 75 number percent, and a number ratio of the carbon black having a primary particle size between a range of the mean primary particle size+15 nm and a mean primary particle size+45 nm is between 15 and 35 number percent.

9. The black toner of claim 8, in which a number ratio of the carbon black having a primary particle size between a range of the mean primary particle size+25 nm and a mean primary particle size+55 nm is between 5 and 30 number percent.

10. The black toner of claim 8, in which:

a number ratio of the carbon black having a primary particle size within the range of the mean primary particle size±5 nm is between 20 and 35 number percent, a number ratio of the carbon black having a primary particle size within the range of the mean primary particle size ±15 nm is between 50 and 70 number percent, and a number ratio of the carbon black having a primary particle size between the range of the mean primary particle size±15 nm and the mean primary particle size+45 nm is between 15 and 30 number percent.

11. The black toner of claim 10, in which a mean primary particle size of the carbon black is within a range between 20 and 30 nm.

12. The black toner of claim 10, in which a number ratio of the carbon black having a primary particle size between a range of the mean primary particle size+25 nm and a mean primary particle size+55 is between 10 and 25 number percent.

13. The black toner of claim 8, in which the carbon black has a pH of 7–9.

14. The black toner of claim 8, in which the binder resin has a number average molecular weight of 3,000 to 6,000, a ratio of weight average molecular weight to number average molecular weight of 1 to 8, a glass transition point of 50° to 75° C. and a softening point of 90° to 115° C.

15. The black toner of claim 8, in which the magenta toner comprises a binder resin and a magenta coloring agent, the cyan toner comprises a binder resin and a cyan coloring agent and the yellow toner comprises a binder resin and a yellow coloring agent, the binder resin in each toner having a number average molecular weight of 3,000 to 6,000, a ratio of weight average molecular weight to number average molecular weight of 1 to 8, a glass transition point of 50° to 75° C. and a softening point of 90° to 115° C.

16. A toner for a full color image-forming machine that reproduces multicolor images by using magenta toner, cyan toner, yellow toner and black toner, wherein the toner comprises a binder resin and a carbon black, wherein the carbon black is contained at an amount of 2 to 7 parts by weight on a basis of 100 parts by weight and has an average primary particle size within a range between 15 and 35 nm, a pH between 7 and 9, a BET specific surface area between 50 and 90 $m^2/g$, and an oil absorption between 50 and 90 ml/100 g;

the magenta toner comprises a magenta coloring agent and a binder resin having a number average molecular weight of 3,000 to 6,000, a ratio of weight average molecular weight to number average molecular weight of 1 to 8, a glass transition point of 50° to 75° C. and a softening point of 90° to 115° C.;

the cyan toner comprises a cyan coloring agent and a binder resin having a number average molecular weight of 3,000 to 6,000, a ratio of weight average molecular weight to number average molecular weight of 1 to 8, a glass transition point of 50° to 75° C. and a softening point of 90° to 115° C.;

the yellow toner comprises a yellow coloring agent and a binder resin having a number average molecular weight of 3,000 to 6,000, a ratio of weight average molecular weight to number average molecular weight of 1 to 8, a glass transition point of 50° to 75° C. and a softening point of 90° to 115° C.

17. The toner of claim 16, in which the carbon black has an average primary particle size within a range between 20 and 30 nm, a BET specific surface area between 55 and 85 $m^2/g$, and an oil absorption between 60 and 80 ml/100 g.

18. The toner of claim 16, in which the binder resin of the black toner has a number average molecular weight of 3,000 to 6,000, a ratio of weight average molecular weight to number average molecular weight of 1 to 8, a glass transition point of 50° to 75° C. and a softening point of 90° to 115° C.

19. The toner of claim 16, in which the binder resin in each of the magenta, cyan and yellow toner has a number average molecular weight of 3,500 to 5,500, a ratio of weight average molecular weight to number average molecular weight of 2 to 6, a glass transition point of 55° to 70° C. and a softening point of 90° to 110° C.

20. The toner of claim 16, in which the carbon black is contained at an amount of 3 to 5 parts by weight on a basis of 100 parts by weight of the binder resin.

* * * * *